US011600928B2

(12) United States Patent
Hashimoto

(10) Patent No.: US 11,600,928 B2
(45) Date of Patent: Mar. 7, 2023

(54) ANTENNA APPARATUS AND SEARCH APPARATUS

(71) Applicant: KABUSHIKI KAISHA TOSHIBA, Tokyo (JP)

(72) Inventor: Koh Hashimoto, Yokohama Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 17/016,625

(22) Filed: Sep. 10, 2020

(65) Prior Publication Data

US 2021/0218146 A1 Jul. 15, 2021

(30) Foreign Application Priority Data

Jan. 15, 2020 (JP) ..... JP2020-004593

(51) Int. Cl.
*H01Q 13/20* (2006.01)
*H01Q 1/38* (2006.01)
(Continued)

(52) U.S. Cl.
CPC ..... *H01Q 13/20* (2013.01); *H01Q 1/38* (2013.01); *H01Q 15/10* (2013.01); *H01Q 19/20* (2013.01)

(58) Field of Classification Search
CPC ..... H01Q 13/20; H01Q 1/38; H01Q 15/10; H01Q 19/20; H01Q 21/0006; H01Q 13/28;
(Continued)

(56) References Cited

U.S. PATENT DOCUMENTS 10,270,180 B2 4/2019 Kasahara
2005/0140556 A1* 6/2005 Ohno ..... H01Q 21/08 343/770
(Continued)

FOREIGN PATENT DOCUMENTS

WO WO 2007/026792 A1 3/2007
WO WO 2015/118586 8/2015

OTHER PUBLICATIONS

Liu, Juhua, et al., "Substrate Integrated Waveguide (SIW) Leaky-Wave Antenna With Transverse Slots," IEEE Transactions on Antenna and Propagation, vol. 60, No. 1, pp. 20-29 (Jan. 2020).
(Continued)

*Primary Examiner* — Andrea Lindgren Baltzell
*Assistant Examiner* — Yonchan J Kim
(74) *Attorney, Agent, or Firm* — Finnegan, Henderson, Farabow, Garrett & Dunner, LLP

(57) ABSTRACT

According to one embodiment an antenna apparatus includes: a first conductor layer; a second conductor layer; a dielectric layer between the first and the second conductor layers; a plurality of first conductor vias corresponding to a first direction; a plurality of second conductor vias opposed to the first conductor vias corresponding to the first direction; and a plurality of first openings in the first direction in a region of the first conductor layer between the first and the second conductor vias. A plurality of third conductor vias are part of the plurality of first conductor vias and are arranged along the first openings. Positions of the third conductor vias in a second direction are different from positions of others of the first conductor vias in the second direction, the second direction is substantially orthogonal to the first direction and is substantially parallel to the first conductor layer.

20 Claims, 8 Drawing Sheets

(51) Int. Cl.
*H01Q 15/10* (2006.01)
*H01Q 19/20* (2006.01)

(58) Field of Classification Search
CPC ..... H01Q 21/0037; H01Q 21/005; H01Q 21/064; H01Q 21/08
See application file for complete search history.

(56) References Cited

U.S. PATENT DOCUMENTS

| | | | | |
|---|---|---|---|---|
| 2009/0066597 | A1* | 3/2009 | Yang | H01Q 21/005 343/771 |
| 2015/0222023 | A1* | 8/2015 | Shijo | G01S 13/4463 342/195 |
| 2016/0126637 | A1* | 5/2016 | Uemichi | H01Q 21/0043 343/771 |
| 2020/0227808 | A1* | 7/2020 | Salem | H01Q 25/02 |

OTHER PUBLICATIONS

Ranjan, Ratnesh, et al., "SIW-Based Leaky-Wave Antenna Supporting Wide Range of Beam Scanning Through Broadside," IEEE Antennas and Wireless Propagation Letters, vol. 18, No. 4, pp. 606-610 (Apr. 2019).

* cited by examiner

ANTENNA APPARATUS AND SEARCH APPARATUS

CROSS REFERENCE TO RELATED APPLICATIONS

This application is based upon and claims the benefit of priority from the prior Japanese Patent Application No. 2020-004593, filed on Jan. 15, 2020, the entire contents of which are incorporated herein by reference.

FIELD

Embodiments described herein relate to an antenna apparatus and a search apparatus.

BACKGROUND

A periodic leaky-wave antenna that includes a periodic leaking structure in a waveguide and radiates plane waves to space outside the waveguide is well-known. The periodic leaky-wave antenna can realize a beam-scanning antenna without a complicated feeding circuit because a radiation direction of the plane waves is changed depending on a frequency. As a kind of the periodic leaky-wave antenna, there is an antenna that uses, a waveguide structure in which conductor vias in two lines are densely arranged in a dielectric substrate including a conductor plate made of copper or the like on each of surfaces, and uses slots provided on one of the conductor plates as a leaking structure (radiation elements). The waveguide structure is called a post-wall waveguide or a substrate integrated waveguide (SIW).

In the above-described structure, the slots having the same dimension are arranged. Therefore, coupling amounts (obtained by dividing radiation power by incident power) of the respective slots are equal to one another. Accordingly, there are issues that an amplitude distribution on an antenna opening surface is exponentially reduced along the waveguide, and high antenna efficiency is not obtainable.

DETAILED DESCRIPTION

According to one embodiment, an antenna apparatus, includes: a first conductor layer; a second conductor layer; a dielectric layer between the first conductor layer and the second conductor layer; a plurality of first conductor vias corresponding to a first direction to penetrate through the dielectric layer and to electrically connect the first conductor layer and the second conductor layer; a plurality of second conductor vias opposed to the first conductor vias corresponding to the first direction and to penetrate through the dielectric layer, and to electrically connect the first conductor layer and the second conductor layer; and a plurality of first openings in the first direction in a region of the first conductor layer between the plurality of first conductor vias and the plurality of second conductor vias.

The plurality of third conductor vias are part of the plurality of first conductor vias and are arranged corresponding to the plurality of first openings.

Positions of the plurality of third conductor vias in a second direction are different from positions of others of the first conductor vias in the second direction.

The second direction is substantially orthogonal to the first direction and is substantially parallel to the first conductor layer.

Below, embodiments are described with reference to drawings.

First Embodiment

An antenna apparatus according to a first embodiment is described below with reference to FIG. 1 to FIGS. 3A and 3B.

Figure 1:
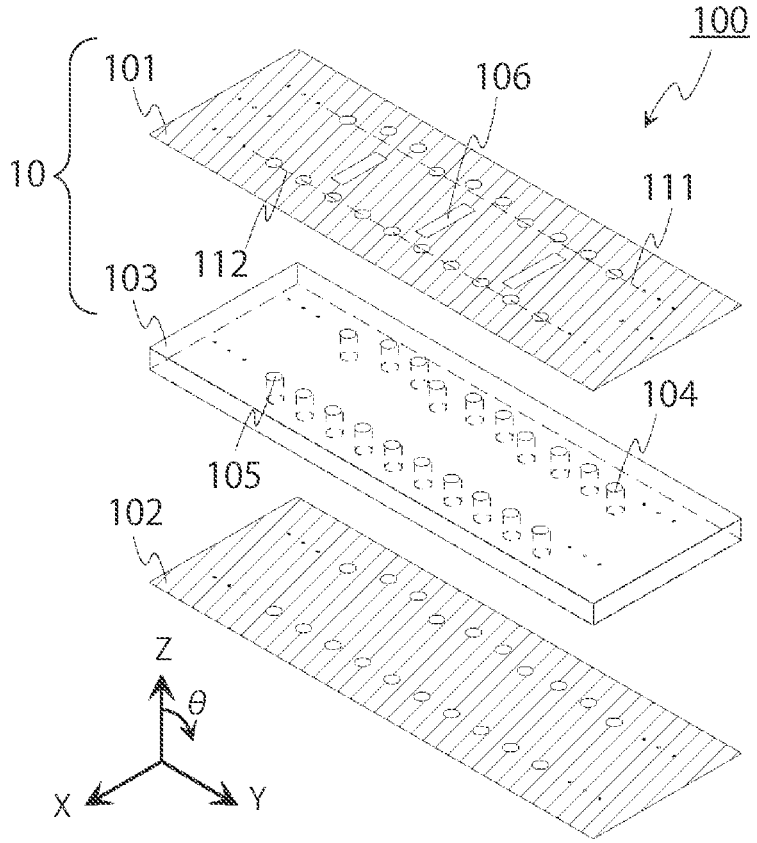
FIG. 1 is an exploded perspective view of an antenna apparatus according to a first embodiment.
Figure 2:
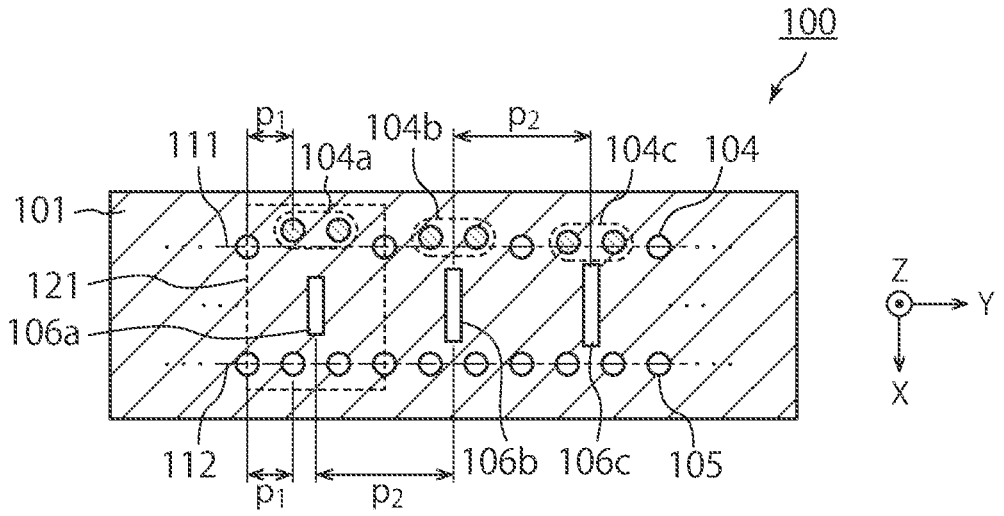
FIG. 2 is a top view of the antenna apparatus according to the first embodiment.

FIG. 1 is an exploded perspective view of an antenna apparatus 100 according to the first embodiment. FIG. 2 is a top view of the antenna apparatus 100 in FIG. 1.

In FIG. 1, the antenna apparatus 100 includes a substrate 10 that includes a first conductor layer 101, a second conductor layer 102, and a dielectric layer 103.

A plurality of first conductor vias 104 penetrating through the substrate 10 (first conductor layer 101, second conductor layer 102, and dielectric layer 103) are arranged corresponding to a first direction. More specifically, the first conductor vias 104 are arranged corresponding to a first straight line 111 extending in the first direction.

A plurality of second conductor vias 105 penetrating through the substrate 10 (first conductor layer 101, second conductor layer 102, and dielectric layer 103) are arranged corresponding to the first direction. More specifically, the second conductor vias 105 are arranged corresponding to a second straight line 112 substantially parallel to the first straight line 111. The second conductor vias 105 are provided in parallel with the first conductor vias 104.

The first straight line 111 and the second straight line 112 are illustrated by dashed lines. The first straight line 111 and the second straight line 112 are tentative lines for description. The first conductor vias 104 conduct the first conductor layer 101 and the second conductor layer 102. The second conductor vias 105 conduct the first conductor layer 101 and the second conductor layer 102. The first straight line 111 and the second straight line 112 are parallel to a y-axis of an xyz coordinate system provided in the figure for convenience. The first direction corresponds to a y-axis direction.

In a direction (i.e., y-axis direction) parallel to the first straight line 111, the first conductor vias 104 are arranged at a first period (first interval) "$p_1$". In a direction (i.e., y-axis direction) parallel to the second straight line 112, the second conductor vias 105 are arranged at the same first period (first interval) "$p_1$".

The first conductor layer 101, the second conductor layer 102, the dielectric layer 103, the plurality of first conductor vias 104, and the plurality of second conductor vias 105 configure a waveguide that is called a post-wall waveguide or a substrate integrated waveguide (SIW).

In a case where a diameter of each of the first conductor vias 104 and the second conductor vias 105 is small relative to a wavelength and the first period "$p_1$" is small relative to the wavelength, the plurality of first conductor vias 104 and the plurality of second conductor vias 105 each function as an equivalent conductor wall to electromagnetic waves propagating through a region that is surrounded by the first conductor layer 101, the second conductor layer 102, the plurality of first conductor vias 104, and the plurality of conductor vias 105. Accordingly, the first conductor layer 101, the second conductor layer 102, the dielectric layer 103, the plurality of first conductor vias 104, and the plurality of conductor vias 105 function as an equivalent conductive waveguide filled with a dielectric. The first conductor layer 101 and the second conductor layer 102 correspond to broad walls of the waveguide, and the plurality of first conductor vias 104 and the plurality of second conductor vias 105 correspond to narrow walls of the waveguide.

The dielectric layer 103 is, for example, a dielectric substrate. As the dielectric substrate, a resin substrate made of polytetrafluoroethylene (PTFE), modified polyphenylene ether (PPE), or the like; a film substrate made of resin foam, a liquid crystal polymer, a cycloolefin copolymer (COP), or the like; a ceramic substrate made of low temperature co-fired ceramics (LTCC), high temperature co-fired ceramics (HTCC), or the like; or a glass substrate is used. Each of the first conductor layer 101 and the second conductor layer 102 is a conductor plate made of a metal such as copper. As an example, the substrate 10 is formed by bonding the conductor plate on each of surfaces of the dielectric substrate.

As an example, the first conductor vias 104 and the second conductor vias 105 are formed in such a manner that holes are provided in the substrate 10, and side surfaces of the respective holes are plated or filled with conductive paste containing metal or metal particles of copper, silver, gold, or the like.

The dielectric layer 103 may be a single layer, or may include a plurality of stacked dielectric layers. Further, the first conductor vias 104 and the second conductor vias 105 each may have a uniform shape in a direction (z-axis direction in figure) penetrating through the first conductor layer 101 and the second conductor layer 102, or may have a nonuniform shape in the z-axis direction. In a case where the dielectric layer 103 includes a plurality of dielectric layers, conductor vias provided in each of the dielectric layers may be stacked in the z-axis direction.

In a region of the first conductor layer 101 sandwiched between the first conductor vias 104 and the second conductor vias 105 (or region of first conductor layer 101 sandwiched between first straight line 111 and second straight line 112), first openings (slots) 106 operating as radiation elements are provided.

In FIG. 2, as examples of the first openings 106, three first openings 106*a*, 106*b*, and 106*c* are illustrated. When the first openings 106*a*, 106*b*, and 106*c* are not particularly distinguished from one another, those are described as the first openings 106. The first openings 106 are provided in parallel with the first conductor vias 104 or the second conductor vias 105. More specifically, the plurality of first openings 106 are arranged in a direction (i.e., y-axis direction in figure) substantially parallel to the first straight line 111 or the second straight line 112. In other words, the first openings 106 are arranged in the first direction.

The first openings 106 are arranged at a second period (second interval) "$p_2$". Each of the first openings 106 has a rectangular shape. A longitudinal direction of each of the first openings 106 is orthogonal to a longitudinal axis (i.e., y-axis) of the post-wall waveguide. The first openings 106 may be arranged such that the longitudinal direction of each of the first openings 106 is parallel to the longitudinal axis (i.e., y-axis) of the post-wall waveguide or obliquely intersects with the y-axis. Each of the first openings 106 may have a rectangular shape with rounded corners, an elliptical shape, a dumbbell shape, or the like. The first openings 106 are also called slots, and operate as slot antenna.

The antenna apparatus 100 operates as a periodic leaky-wave antenna that includes the post-wall waveguide as the waveguide and the openings 106 as the radiation elements (leaking structure). The periodic leaky-wave antenna is also called PLWA. The periodic leaky-wave antenna is an antenna using a phenomenon called leaky waves. The leaky waves are plane wave radiated to a space outside the waveguide (transmission line) when a continuous or periodic leaking structure is provided in the waveguide.

Note that the leaky waves are generated only in a case of fast waves. The fast waves indicate that an absolute value of a phase speed "$v_p$" of the waves propagating inside the waveguide structure is larger than a light speed in the outside space. In other words, the fast waves indicate that an absolute value of a phase constant "β" of the waves propagating inside the waveguide structure is lower than a wave number in the outside space. In still other words, the fast waves indicate that an guide wavelength "$\lambda_g$" of the waves propagating inside the waveguide structure is longer than a wavelength in the outside space.

When the outside space is a vacuum free space, a condition of the fast waves is represented in three forms as represented in an expression (1) by using a light speed c, a wave number "$k_0$", and a wavelength "$\lambda_0$" in vacuum. Satisfaction of the condition of the fast waves correspond to satisfaction of any of the three conditions represented in the expression (1).

$$\begin{cases} |v_p| > c \\ |\beta| < k_0 \\ \lambda_g > \lambda_0 \end{cases} \tag{1}$$

When the condition of the fast waves is satisfied, a radiation angle "θ" of the plane waves is represented by an expression (2). At this time, electromagnetic waves propagate inside the waveguide in the y-axis positive direction.

$$\theta = \sin^{-1}\left(\frac{\beta}{k_0}\right) \tag{2}$$

In the periodic leaky-wave antenna, the radiation angle is changed with change of a frequency. Therefore, the periodic leaky-wave antenna is usable as a beam-scanning antenna. Unnecessity of a complicated feeding circuit for beam scanning and unnecessity of a phase shifter unlike a phased array antenna are advantages of the periodic leaky-wave antenna.

As a comparative example, there is a leaky-wave antenna including one slit on a waveguide (e.g., hollow waveguide) of the fast waves. In contrast, the periodic leaky-wave antenna (PLWA) according to the present embodiment is an antenna using a waveguide (e.g., substrate including dielectric layer having relative permittivity of about 2 or more) of slow waves. When the relative permittivity of the dielectric layer is about 2 or more, the post-wall waveguide is a waveguide of the slow waves in a dimension of a broad wall width normally used. The dielectric layer 103 according to the present embodiment also has the relative permittivity of about 2 or more. When the periodic leaking structure is provided in the waveguide of the slow waves, the waves propagating inside the waveguide become the fast waves (i.e., condition of fast waves is satisfied), and the leaky waves are generated. In the antenna apparatus 100, the plurality of first openings 106 arranged at the second period "$p_2$" in the y-axis direction correspond to the periodic leaking structure.

In the periodic structure, an infinite number of spatial harmonics (Floquet modes) each having a propagation constant represented by an expression (3) are generated from Floquet theorem.

$$k_{yn} = k_{y0} + \frac{2\pi n}{p_2} \tag{3}$$

The expression (3) is an expression in a case where the y-axis corresponds to the longitudinal axis direction of the waveguide, and "n" is an integer, "$k_{yn}$" is a propagation constant of an nth-order Floquet mode, and a denominator of a second term on a right side is the second period "$p_2$" that is the arrangement period of the first openings 106.

In the expression (3), "$k_{y0}$" is a propagation constant of an 0th-order Floquet mode. The propagation constant "$k_{y0}$" is given by an expression (4) with use of a phase constant "$\beta_0$" and an attenuation constant "$\alpha$" of the waveguide not provided with the leaking structure. In the expression (4), "j" is an imaginary number.

[Expression 4]

$$k_{y0}=\beta_0-j\alpha \tag{4}$$

The leaky waves are generated in the case of the fast waves. Therefore, attention is paid to a phase constant "$\beta_{yn}$" of the nth-order Floquet mode. The phase constant "$\beta_{yn}$" is given by an expression (5) because the phase constant "$\beta_{yn}$" is a real part of the propagation constant "$k_{yn}$".

$$\beta_{yn} = \beta_0 + \frac{2\pi n}{p_2} \tag{5}$$

Out of the infinite number of Floquet modes, only mode of an order as the fast waves causes the leaky waves. The condition of the fast waves relating to the phase constant "$\beta_{yn}$" is represented by an expression (6).

[Expression 6]

$$-k_0<\beta_{yn}<k_0 \tag{6}$$

As described above, since the waveguide of the slow waves is used in the periodic leaky-wave antenna (PLWA), the 0th-order mode does not generate the leaky waves. Note that the 0th-order mode corresponds to a mode in a case where no opening (leaking structure) is provided in the post-wall waveguide (waveguide of slow waves).

The nth-order mode that satisfies the expression (6) generates the leaky waves, where "n" is a negative integer. Since Floquet modes different in the order (n) have different phase constants, the radiation angle "θ" given by the expression (2) is also changed depending on the order. In a case where a plurality of nth-order Floquet modes satisfy the condition of the fast waves, the leaky waves are generated in a direction corresponding to the phase constant of each of the orders. Therefore, the antenna operates as a multibeam antenna. In the present embodiment, the dielectric used in the waveguide, the arrangement period of the radiation elements (leaking structure), and the like are determined such that, as an example, only the −1th-order Floquet mode satisfies the condition of the fast waves. The plurality of nth-order Floquet modes may satisfy the condition of the fast waves.

In a case where the first openings (slots) 106 arranged at the second period "$p_2$" in the y-axis direction each have the same dimension, namely, in a case where the slot antennas each having the same dimension are arranged, coupling amounts (obtained by dividing radiation power by incident power) of the respective slots are equal to one another. Accordingly, in a case where the electromagnetic waves propagate inside the waveguide in the y-axis positive direction, the amplitude distribution on the antenna opening surface is exponentially reduced as it goes in the y-axis positive direction. Accordingly, it is difficult to realize high antenna efficiency.

In FIG. 2, the first openings (slots) 106*a* to 106*c* are different in dimension from one another. The dimension of each of the first openings (slots) is increased as it goes in the y-axis positive direction. In a case where the longitudinal direction of each of the first openings 106*a* to 106*c* is orthogonal to the longitudinal axis (direction of waveguide) of the post-wall waveguide (i.e., x-axis direction), the coupling amounts can be controlled mainly by the longitudinal dimensions (slot lengths) of the first openings 106*a* to 106*c*. The slot length of the slot, the necessary coupling amount of which is small, is made short, and the slot length of the slot, the necessary coupling amount of which is large, is made large.

As an example, in a case of a transmission antenna, the amplitude distribution on the antenna opening surface is made uniform. The amplitude of the waves propagating inside the waveguide is reduced as it goes from a feeding side toward a termination side. In a case of a kth element counted from the termination side opposite to the feeding side, the necessary coupling amount is 1/k as an example. Therefore, the slot length is increased from the feeding side toward the termination side.

In FIG. 2, the y-axis negative direction corresponds to the feeding side, the y-axis positive direction corresponds to the termination side, and the slot length is large in order of the first openings (slots) 106*a*, 106*b*, and 106*c*.

In FIG. 2, first conductor vias 104*a* to 104*c* of the first conductor vias 104 are shifted in the x-axis negative direction (direction opposite to second conductor vias) in the figure. In other words, the first conductor vias 104*a* to 104*c* are shifted to a side opposite to the second straight line 112 in a direction substantially orthogonal to the first straight line 111. In the present specification, shifting of some of the first conductor vias in the above-described manner is referred to as "offsetting". Among the first conductor vias, the offset first conductor vias correspond to third conductor vias. In FIG. 2, the offset first conductor vias are illustrated by hatched circles for identification. As described above, although the first conductor vias 104 are arranged so as to extend in the first direction as a whole, the first conductor vias 104*a* to 104*c* of the first conductor vias 104 are arranged at positions shifted from the first straight line 111. Even in the case where some of the first conductor vias 104 are arranged at the shifted positions as described above, it is defined that the whole of the plurality of first conductor vias 104 including the first conductor vias 104*a* to 104*c* are arranged corresponding to the first direction in the present embodiment. The offset first conductor vias (third conductor vias) are, for example, conductor vias that are separated by a first distance or less from the first openings 106*a* to 106*c* in the y-axis direction. The first distance is dependent on a difference between the maximum coupling amount and the minimum coupling amount among the plurality of coupling amounts held by the plurality of openings.

The first conductor vias 104*a* to 104*c* of the first conductor vias 104 are arranged at positions corresponding to the respective first openings 106*a* to 106*c*. The first conductor vias 104*a* to 104*c* of the first conductor vias 104 each include two first conductor vias near the x-axis negative direction side of the respective slots 106*a* to 106*c*. The two first conductor vias are offset by the same distance in a direction away from a corresponding one of the slots 106*a* to 106*c*. The positions of the first conductor vias 104*a* to 104*c* in the x-axis direction (second direction) are adjusted (different) based on the coupling amounts of the respective corresponding slots 106*a* to 106*c*. In the example of FIG. 2, the slots 106*a* to 106*c* are reduced in distance from the respective first conductor vias (104*a*, 104*b*, and 104*c*) at the positions corresponding to the slots 106*a* to 106*c* as it goes in the waveguide direction (a propagation direction of electromagnetic wave). In the x-axis direction (second direction), the first conductor vias 104*a* to 104*c* are located on a side opposite to the plurality of second conductor vias 105 with respect to the positions of the first conductor vias other than the first conductor vias 104*a* to 104*c*. As a result, phase delay corresponding to the offset amount of the first conductor vias 104*a* to 104*c* occurs in the slots 106*a* to 106*c*. Therefore, the phase constants of the Floquet modes around the slots 106*a* to 106*c* can be adjusted to be substantially the same.

Figure 3A:
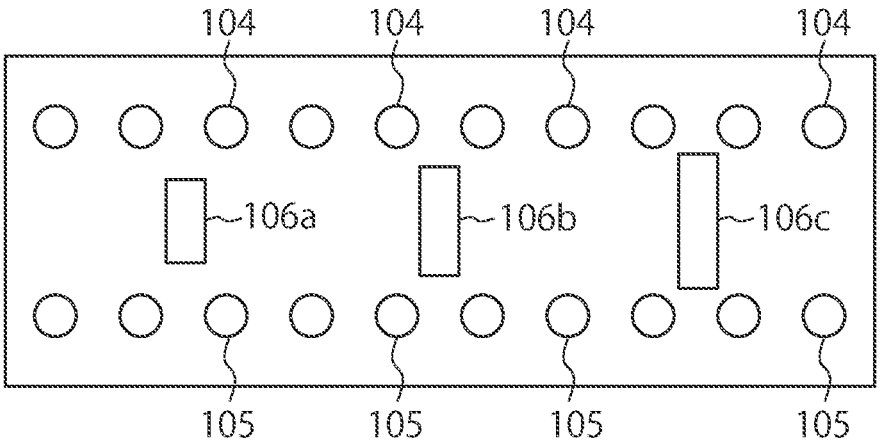
FIGS. 3A and 3B each is a supplementary diagram for the first embodiment.
Figure 3B:
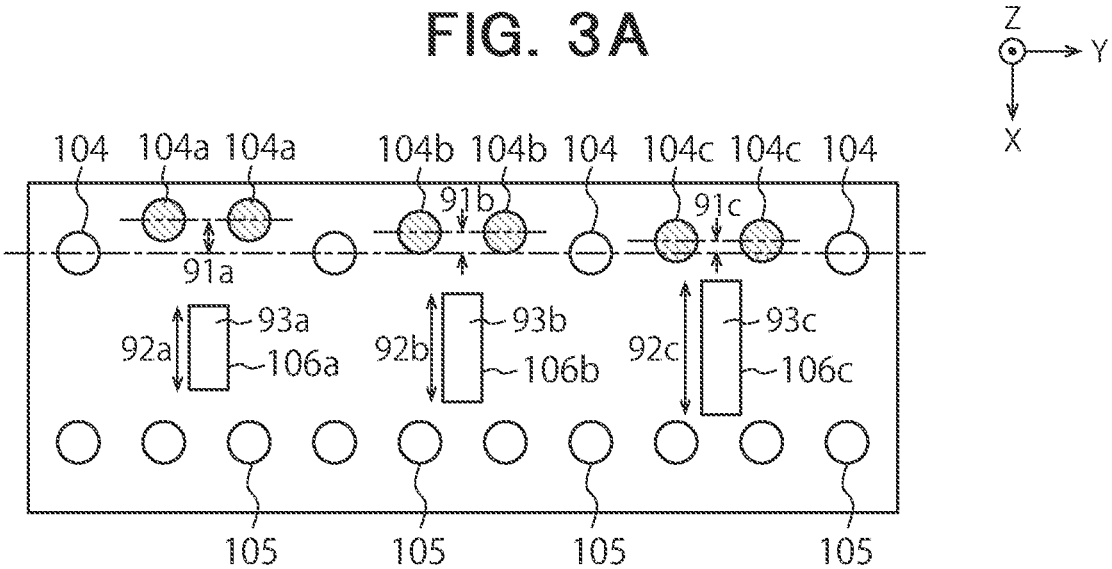

FIGS. 3A and 3B each is a supplementary diagram of the present embodiment. FIG. 3A is a top view illustrating an example in which slots having different dimensions are simply arranged corresponding to the y-axis direction and none of the first conductor vias 104 is offset. The elements are denoted by the same reference numerals in FIG. 2 for convenience. In this case, the phase constants of the Floquet modes around the slots 106*a* to 106*c* are not equal for each slot. In the case where the phase constants are different, the radiation angles of the leaky waves are also varied. Therefore, the radiation angles of the leaky waves are not aligned, which deteriorates the antenna gain. Therefore, in the present embodiment, as illustrated in FIG. 3B, among the plurality of first conductor vias 104, the first conductor vias 104*a* to 104*c* near the respective slots 106*a* to 106*c* are offset in the direction opposite to the slots 106*a* to 106*c*, to adjust the phase constants of the Floquet modes around each of the slots. In other words, the positions of the first conductor vias 104*a* to 104*c* in the x-axis direction (second direction) are adjusted based on the coupling amounts of the corresponding slots 106*a* to 106*c*. In the x-axis direction, the first conductor vias 104*a* to 104*c* are located on the side opposite to the plurality of second conductor vias 105 with respect to the positions of the first conductor vias other than the first conductor vias 104*a* to 104*c*. Offset amounts 91*a* to 91*c* of the respective first conductor vias 104*a* to 104*c* or distances between the first conductor vias 104*a* to 104*c* and the respective slots 106*a* to 106*c* are gradually reduced as it goes in the waveguide direction. Further, longitudinal lengths 92*a* to 92*c* or areas 93*a* to 93*c* of the slots 106*a* to 106*c* are gradually increased as it goes in the waveguide direction. In the example of the figure, short-side lengths of the slots 106*a* to 106*c* are equal to one another; however, the short-side lengths are not limited thereto. The short-side lengths of the slots may be increased or decreased as it goes in the waveguide direction. As described above, adjusting the positions of the first conductor vias 104*a* to 104*c* makes it possible to make the phase constants of the Floquet modes around the slots substantially coincident with one another irrespective of the longitudinal lengths or the areas of the slots, namely, irrespective of the coupling amounts of the slots.

At this time, the arrangement period (second period) "$p_2$" of the slots is an integer multiple of the arrangement period (first period) "$p_1$" of the first conductor vias 104. This facilitates the adjustment of the phase constants. In the example of FIG. 2, $p_2=3p_1$ is established. First unit cells 121 each including three first conductor vias 104, three second conductor vias 105, and one first opening 106 are arrayed at the second period "$p_2$" in the y-axis direction. In FIG. 2, although the first unit cell 121 including the first opening 106*a* is illustrated by a dashed frame, the first unit cell 121 including the other first opening is also defined in a similar manner. In a case where the second period "$p_2$" is an integer multiple of the first period "$p_1$", relative positional relationship in the y-axis direction between the first conductor vias 104*a* to 104*c* offset in the x-axis negative direction among the first conductor vias 104 and the respective slots 106*a* to 106*c* is equivalent or substantially equivalent (hereinafter, equivalent in relative positional relationship includes substantially equivalent) for the slots 106*a* to 106*c*. This facilitates the adjustment to make the phase constants of the Floquet modes around the slots substantially coincident with one another.

An advantage that the second period "$p_2$" as the arrangement period of the slots is an integer multiple of the first period "$p_1$" as the arrangement period of the first conductor vias 104 is described in detail. An equivalent broad wall width of the post-wall waveguide depends on the relative permittivity of the dielectric, the diameter of each of the conductor vias, the distance between the two conductor via lines, and the arrangement period (first period "$p_1$") of the conductor vias. Accordingly, the period is normally determined such that the equivalent broad wall width of the post-wall waveguide becomes a desired value. On the other hand, the arrangement period (second period "$p_2$") of the slots is determined such that the radiation direction "θ" of the leaky waves represented by the expression (2) becomes a desired direction, namely, the phase constant represented by the expression (5) becomes a desired value. Therefore, the relative positional relationship in the y-axis direction between some of the conductor vias offset in the x-axis negative direction and the slots is not necessarily equivalent for all of the slots. In other words, the relative positional relationship in the y-axis direction between some of the conductor vias and the slots may be different depending on the slots. In this case, it is necessary to optimize the slot lengths and the offset amounts of the conductor vias in consideration of the relative positional relationship in the y-axis direction between some of the conductor vias and the slots for each slot, which makes the adjustment of the phase constants difficult. In this regard, in the present embodiment, the first unit cells 121 are configured while the second period "$p_2$" is an integer multiple of the first period "$p_1$", which facilitates the adjustment of the phase constants in the slots.

As described above, in the present embodiment, the adjustment to make the phase constants of the Floquet modes around the slots substantially coincident with one another can be easily performed. Accordingly, the coupling amounts of the slots can be continuously or stepwisely controlled under the condition to obtain the same phase constant in each of the slots.

A specific example is described. A phase delay occurred in a slot is large as a coupling amount of the slot is large. Accordingly, an adjustment amount of the phase delay is large and an offset amount of a conductor via is also large as the coupling amount of the slot is small. Therefore, in the unit cell including the slot having the maximum coupling amount, the distance (offset amount) between some of the first conductor vias and the slots is made minimum. Further, in the unit cell including the slot having the coupling amount smaller than the maximum coupling amount, the distance (offset amount) between some of the first conductor vias and the slots is made large. As described above, the phase constant of the unit cell including the slot having the small coupling amount is adjusted based on the phase constant of the unit cell including the slot having the maximum coupling amount.

Note that the phase constant of the unit cell including the slot having the maximum coupling amount becomes an adjustment target value. Therefore, the conductor vias in the unit cell including the slot having the maximum coupling amount may not be offset. This suppresses the offset amount of some of the first conductor vias 104 in the unit cell including the slot other than the slot having the maximum coupling amount, thereby suppressing leakage of the electromagnetic waves from the post-wall waveguide.

In the example of FIG. 2, in the first unit cell 121, the two first conductor vias located at positions corresponding to the slot are offset by the same distance in the x-axis negative direction. The offset amounts of the two first conductor vias, however, may be different from each other based on the necessary adjustment amount of the phase constant. Alternatively, only one first conductor via may be offset.

The first conductor vias located at the positions corresponding to the slot may be a predetermined number of first conductor vias closest to the slot in the y-axis direction or first conductor vias optionally selected from the predetermined number of first conductor vias. Alternatively, the first conductor vias located at the positions corresponding to the slot may be first conductor vias overlapped with the slot in a direction that is orthogonal to the first straight line 111 and is parallel to the substrate surface. The first conductor vias located at the positions corresponding to the slot may be defined by a method other than the described method.

As a comparative example, another method of adjusting the phase constant is described. For example, new conductor vias may be provided between the first straight line 111 and the second straight line 112. By this method, however, in a case where the used frequency of the antenna is in a high frequency band such as a millimeter wave band, a manufacturable diameter of each of the conductor vias is increased in dimension in wavelength conversion as compared with a low frequency band such as a micrometer wave band. This easily causes large reflected waves. Further, large phase advance occurs, and adjustment of the phase constant cannot be realized accordingly.

In contrast, in the present embodiment, the first conductor vias 104*a* to 104*c* of the first conductor vias 104 configuring the narrow walls of the post-wall waveguide are offset to the outside of the post-wall waveguide. By this method, relatively small phase delay can be generated and the phase constants can be easily adjusted. In addition, the adjustment does not cause large reflected waves. Accordingly, the present embodiment is suitable for improvement of the antenna efficiency of the PLWA.

As described above, according to the first embodiment, the first openings 106 having different dimensions are used as the radiation elements, and the first conductor vias 104*a* to 104*c* of the first conductor vias 104 are offset to the outside of the post-wall waveguide based on the coupling amounts of the first openings 106. This makes it possible to adjust the phase constants around the radiation elements to be the same, and desired amplitude distribution can be obtained on the opening surface of the periodic leaky-wave antenna (PLWA).

Further, the second period "$p_2$" that is the arrangement period of the first openings 106 in the longitudinal axis direction of the post-wall waveguide is an integer multiple of the first period "$p_1$" that is the arrangement period of the first conductor vias 104 and the second conductor vias 105 in the longitudinal axis direction of the post-wall waveguide. As a result, the antenna apparatus has the structure in which the first unit cells 121 are arrayed, and the relative positional relationship in the longitudinal axis direction of the post-wall waveguide between the first openings 106 and the first conductor vias 104*a* to 104*c* of the first conductor vias 104 is made equivalent among the first unit cells 121. Thus, the coupling amounts of the slots in the first unit cells 121 can be continuously or stepwisely controlled while the phase constants are made equal among the first unit cells 121. Accordingly, the amplitude distribution on the antenna opening surface can be easily controlled, which makes it possible to provide the PLWA with high antenna efficiency.

(Modification 1)

In the present embodiment, some of the first conductor vias 104 are offset to the outside of the post-wall waveguide (in direction away from slots in unit cells including some of first conductor vias); however, some of the conductor vias may be offset to an inside of the post-wall waveguide (in direction approaching slots in unit sells including some of first conductor vias). In a case where some of the conductor vias are offset to the inside, it is possible to generate relatively small phase advance. Accordingly, even with this configuration, the phase constants are relatively easily adjustable. However, a lower limit of a clearance between the slots and the conductor vias is determined by a design rule in a substrate manufacturing process. Therefore, the offset amount to the inside of the post-wall waveguide is restricted by the design rule. In other words, to realize the desired phase adjustment, it is necessary to set the clearance between the slots and the conductor vias to be lower than the lower limit determined by the design rule in some cases. Therefore, it is necessary to offset the conductor vias to the inside of the post-wall waveguide within a range satisfying the design rule.

(Modification 2)

In the present embodiment, to obtain the same amplitude of the output from each of the first openings, the dimensions of the first openings are made large (or coupling amounts are made large) as it goes in the y-axis positive direction, and the offset amount in the x-axis direction of some (third conductor vias) of the first conductor vias are made small (see FIG. 2). However, this shall not apply to a case where the amplitude of the output of the first opening corresponding to a specific direction is weakened or strengthened. For example, the opening in the middle may have the maximum coupling amount or the minimum coupling amount.

In the present embodiment described above, since some of the first conductor vias 104 are offset to the outside of the post-wall waveguide, it is unnecessary to set the clearance between some of the first conductor vias 104 and the slots to be lower than the lower limit determined by the design rule.

The present modification is similarly applicable to second to ninth embodiments described below.

Second Embodiment

An antenna apparatus according to the second embodiment is described below with reference to FIG. 4.

Figure 4:
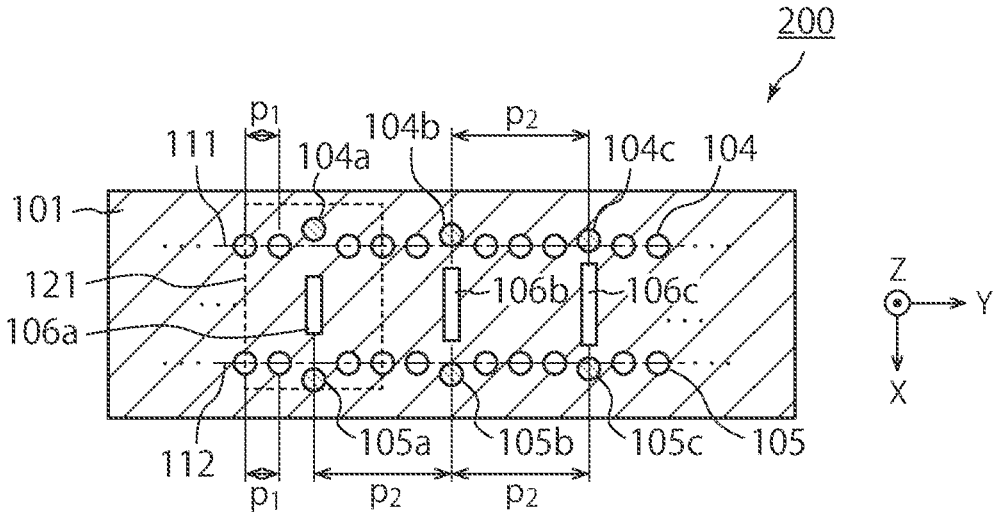
FIG. 4 is a top view of an antenna apparatus according to a second embodiment.

FIG. 4 is a top view of an antenna apparatus 200 according to the second embodiment. In the following description, components similar to the components in the first embodiment are denoted by the same reference numerals, and detailed description of the components is omitted.

In the antenna apparatus 200 according to the second embodiment, the first conductor vias 104*a* to 104*c* of the first conductor vias 104 are offset to the side opposite to the second straight line 112 in the direction substantially orthogonal to the first straight line 111 (i.e., in x-axis negative direction), as with the first embodiment. In addition, second conductor vias 105*a* to 105*c* of the second conductor vias 105 are offset to a side opposite to the first straight line 111 in a direction substantially orthogonal to the second straight line 112 (i.e., in x-axis positive direction). In other words, among the plurality of second conductor vias 105, the second conductor vias 105*a* to 105*c* (plurality of fourth conductor vias) arranged at positions corresponding to the plurality of first openings 106*a* to 106*c* are located at different positions in the x-axis direction, dependently on the coupling amounts of the plurality of first openings 106*a* to 106*c*. In the x-axis direction, the second conductor vias 105*a* to 105*c* are located on a side opposite to the plurality of first conductor vias 104 with respect to the positions of the plurality of second conductor vias 105 other than the second conductor vias 105*a* to 105*c*. The offset second conductor vias (fourth conductor vias) are, for example, conductor vias that are separated by the first distance or less from the first openings 106*a* to 106*c* in the y-axis direction. The first distance is dependent on the difference between the maximum coupling amount and the minimum coupling amount among the plurality of coupling amounts held by the plurality of openings.

In the example of FIG. 4, although the second conductor vias 105*a* to 105*c* of the second conductor vias 105 each include one conductor via 105, the second conductor vias 105*a* to 105*c* each may include two or more conductor vias. Likewise, although the first conductor vias 104*a* to 104*c* of the first conductor vias 104 each include one conductor via 104, the first conductor vias 104*a* to 104*c* each may include two or more conductor vias. Among the second conductor vias, the offset second conductor vias correspond to the fourth conductor vias. The offset second conductor vias are illustrated by hatched circles for identification, as with the offset first conductor vias.

In the example of FIG. 4, in the first unit cells 121, the first conductor vias 104*a* to 104*c* of the first conductor vias 104 and the corresponding second conductor vias 105*a* to 105*c* of the second conductor vias 105 are offset by the same offset amount. However, the first conductor vias 104*a* to 104*c* of the first conductor vias 104 and the corresponding second conductor vias 105*a* to 105*c* of the second conductor vias 105 may be offset by different offset amounts based on the necessary adjustment amounts of the phase constants. Further, the number of first conductor vias 104 to be offset and the number of second conductor vias 105 to be offset may be different from each other.

Figure 4A:
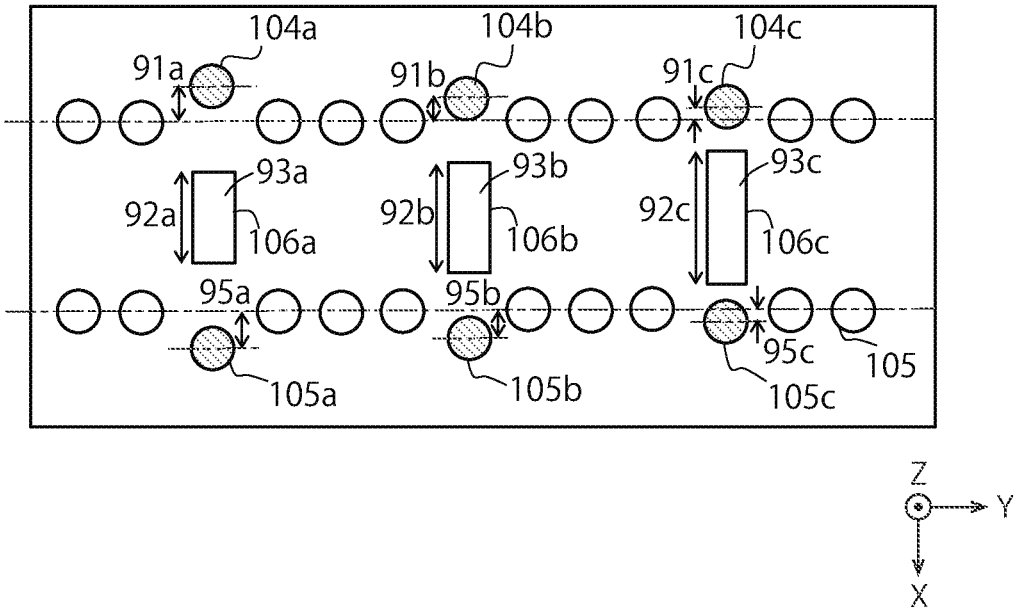
FIG. 4A is a supplementary diagram for the second embodiment.

FIG. 4A is a supplementary diagram of the present embodiment. As with the first embodiment, among the plurality of first conductor vias 104, the first conductor vias 104*a* to 104*c* near the slots 106*a* to 106*c* are respectively offset by the offset amounts 91*a* to 91*c* in the direction opposite to the slots 106*a* to 106*c*. Further, in the present embodiment, among the plurality of second conductor vias 105, the second conductor vias 105*a* to 105*c* near the slots 106*a* to 106*c* are respectively offset by offset amounts 95*a* to 95*c* in the direction opposite to the slots 106*a* to 106*c*. In the x-axis direction, the second conductor vias 105*a* to 105*c* are located on a side opposite to the plurality of first conductor vias 104 with respect to the positions of the second conductor vias 105 other than the second conductor vias 105*a* to 105*c*. In this example, the offset amounts 95*a* to 95*c* are respectively equal to the offset amounts 91*a* to 91*c*; however, the offset amounts are not limited thereto. In other words, in the x-axis direction (second direction), the positions of the first conductor vias 104*a* to 104*c* and the positions of the second conductor vias 105*a* to 105*c* are adjusted dependently on the coupling amounts of the corresponding slots 106*a* to 106*c*. As described above, the phase constants of the Floquet modes around the slots are adjusted by offsetting the second conductor vias 105*a* to 105*c* in addition to the first conductor vias 104*a* to 104*c*. The offset amounts 95*a* to 95*c* of the respective second conductor vias 105*a* to 105*c* or the distances between the second conductor vias 105*a* to 105*c* and the respective slots 106*a* to 106*c* are gradually reduced as it goes in the waveguide direction. Further, as with the first embodiment, the longitudinal lengths 92*a* to 92*c* or the areas 93*a* to 93*c* of the slots 106*a* to 106*c* are gradually increased as it goes in the waveguide direction. In the example of the figure, the short-side lengths of the slots 106*a* to 106*c* are equal to one another; however, the short-side lengths are not limited thereto. The short-side lengths of the slots may be increased or decreased as it goes in the waveguide direction. As described above, adjusting the positions of the first conductor vias 104*a* to 104*c* and the second conductor vias 105*a* to 105*c* makes it possible to make the phase constants of the Floquet modes around the slots substantially coincident with one another irrespective of the longitudinal lengths or the areas of the slots, namely, irrespective of the coupling amounts of the slots.

As with the first embodiment, the second period "$p_2$" is an integer multiple of the first period "$p_1$". In the example of FIG. 4, $p_2=4p_1$ is established. Further, the first unit cells 121 each including four first conductor vias 104, four second conductor vias 105, and one first opening 106 are configured. The first unit cells 121 are arrayed at the second period "$p_2$" in the y-axis direction. Accordingly, relative positional relationship in the y-axis direction between the first conductor vias 104*a* to 104*c* of the first conductor vias 104 and the first openings (slots) 106*a* to 106*c* is equivalent among all of the first unit cells 121. Further, relative positional relationship in the y-axis direction between the second conductor vias 105*a* to 105*c* of the second conductor vias 105 and the first openings (slots) 106*a* to 106*c* is equivalent among all of the first unit cells 121. Accordingly, the phase constants are easily adjustable as with the antenna apparatus 100 according to the first embodiment.

When the second conductor vias 105*a* to 105*c* of the second conductor vias 105 are offset to the side opposite to the first straight line 111 in the direction substantially orthogonal to the second straight line 112 (i.e., in the x-axis positive direction), it is possible to generate phase delay in each of the slots. Accordingly, as compared with the case where only the first conductor vias 104*a* to 104*c* of the first conductor vias 104 are offset in the first embodiment, capability to adjust the phase constants is improved. Widening of the adjustable range of the phase constants enables wide control of the coupling amounts of the respective slots. Therefore, it is possible to control the amplitude distribution on the antenna opening surface more freely.

As described above, according to the second embodiment, the second conductor vias 105*a* to 105*c* of the second conductor vias 105 are offset to the outside of the post-wall waveguide in addition to the first conductor vias 104*a* to 104*c* of the first conductor vias 104. As a result, the adjustable range of the phase constants can be widened. This makes it possible to control the amplitude distribution on the antenna opening surface of the PLWA more flexibly.

Third Embodiment

An antenna apparatus according to the third embodiment is described below with reference to FIG. 5.

Figure 5:
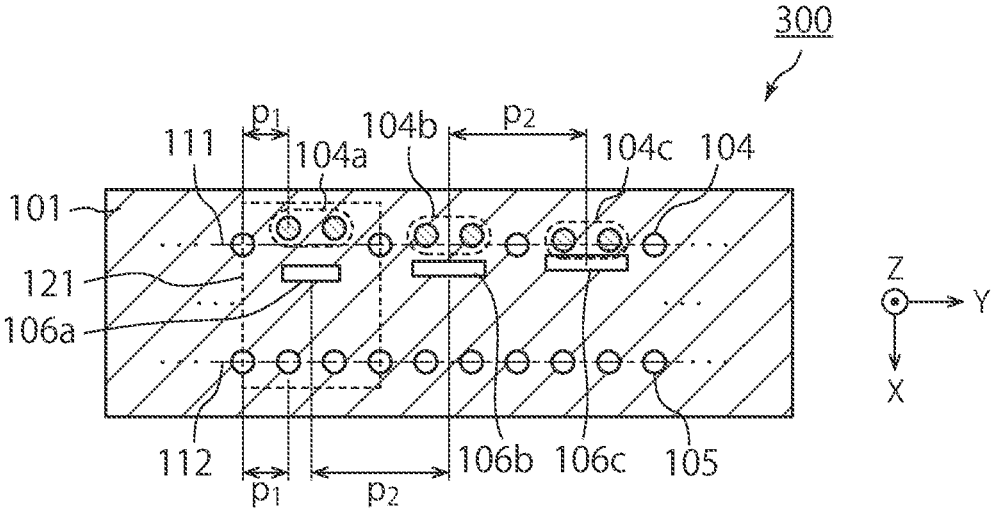
FIG. 5 is a top view of an antenna apparatus according to a third embodiment.

FIG. 5 is a top view of an antenna apparatus 300 according to the third embodiment. In the following description, components similar to the components in the first embodiment are denoted by the same reference numerals, and detailed description of the components is omitted.

In the antenna apparatus 300 according to the third embodiment, the longitudinal direction of each of the first openings (slots) 106 is parallel to the longitudinal axis of the post-wall waveguide, namely, the y-axis. Further, the first openings (slots) 106 are shifted (offset) from the longitudinal axis (center line between first straight line 111 and second straight line 112) of the post-wall waveguide. In the example of FIG. 5, the first openings 106 are offset toward the first straight line 111 (i.e., in x-axis negative direction).

In the case where the longitudinal direction of each of the slots is parallel to the longitudinal axis of the post-wall waveguide, the coupling amounts are controllable mainly by the longitudinal dimensions (slot lengths) of the slots and the offset amounts of the slots. To increase the coupling amounts, the slot lengths are made large or the offset amounts of the slots are made large.

As an example, the coupling amounts can be controlled with use of any one of the slot lengths and the offset amounts of the slots as parameters. In a case where the coupling amounts are controlled only by the slot lengths, the slot lengths are limited by the second period "$p_2$". In a case where the coupling amounts are controlled only by the offset amounts of the slots, the offset amounts are limited by the lower limit of the clearance between the conductor vias and the slots determined by the design rule. Accordingly, when both of the slot lengths and the offset amounts of the slots are used as the parameters, the realizable range of the coupling amounts is wide.

Even in a case where the slots, the longitudinal direction of each of which is parallel to the longitudinal axis of the post-wall waveguide, are used as the radiation elements as in the present embodiment, the phase delay occurred on the slots is increased as the coupling amounts are large. Accordingly, to obtain the PLWA with excellent antenna efficiency, adjustment of the phase constants to the respective slots is necessary. Accordingly, as with the first embodiment, the phase constants among the first unit cells 121 are adjusted to be equal to one another by offsetting the first conductor vias 104*a* to 104*c* of the first conductor vias 104 to the outside of the post-wall waveguide (i.e., in x-axis negative direction). As a result, excellent antenna characteristics are obtainable.

In FIG. 5, a distance (second distance) in the y-axis direction from one of the third conductor vias to the first conductor via other than the plurality of third conductor vias is larger than a distance (third distance) in the y-axis direction from the other on a propagation side of electromagnetic wave in the x-axis direction of the third conductor vias to the first conductor via other than the plurality of third conductor vias. Further, a distance (fourth distance) in the y-axis direction from one of the first openings to the first conductor via other than the plurality of third conductor vias is larger than a distance (fifth distance) in the y-axis direction from the other on the propagation side in the x-axis direction of the first openings to the first conductor via other than the plurality of third conductor vias.

As described above, according to the third embodiment, even in the case where the first openings 106 are slots parallel to the longitudinal axis of the post-wall waveguide, the first openings 106*a* to 106*c* are offset from the longitudinal axis of the post-wall waveguide and the first conductor vias 104*a* to 104*c* of the first conductor vias 104 are offset to the outside of the post-wall waveguide, which makes it possible to realize the PLWA with high antenna efficiency.

Fourth Embodiment

An antenna apparatus according to the fourth embodiment is described below with reference to FIG. 6.

Figure 6:
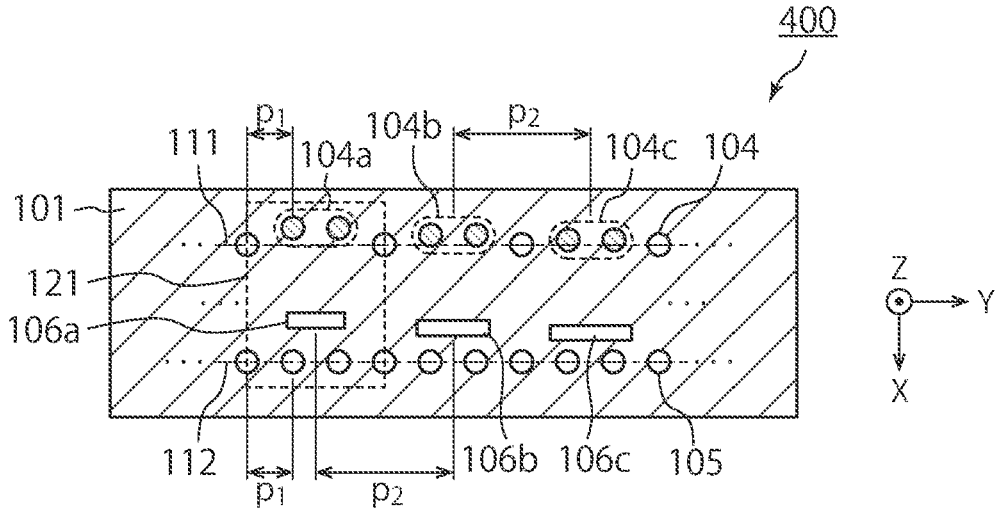
FIG. 6 is a top view of an antenna apparatus according to a fourth embodiment.

FIG. 6 is a top view of an antenna apparatus 400 according to the fourth embodiment. In the following description, components similar to the components in the third embodiment are denoted by the same reference numerals, and detailed description of the components is omitted.

The antenna apparatus 400 according to the fourth embodiment is different from the antenna apparatus according to the third embodiment in that the first openings 106 are offset toward the second straight line 112 (i.e., in x-axis positive direction) from the longitudinal axis of the post-wall waveguide. As with the third embodiment, the first openings 106*a* to 106*c* are slots parallel to the longitudinal axis of the post-wall waveguide. In the present embodiment, the coupling amounts of the first openings (slots) 106*a* to 106*c* are increased as compared with the third embodiment. Therefore, residual power of the PLWA is reduced, and the antenna efficiency is improved. This is described in detail below.

In the above-described antenna apparatus 300 according to the third embodiment illustrated in FIG. 5, in a case where a center in the x-axis direction between the first conductor vias 104*a* to 104*c* of the first conductor vias 104 and the second conductor vias 105 that are located at the same positions in the y-axis direction as the respective first conductor vias 104*a* to 104*c* is used as a reference, the offset amounts of the first openings (slots) 106*a* to 106*c* are OFS1*a* to OFS1*c*. Further, in a case where a center of the longitudinal axis of the post-wall waveguide in a state before the first conductor vias 104*a* to 104*c* of the first conductor vias 104 are offset (in state where first conductor vias 104*a* to 104*c* of first conductor vias 104 are located on first straight line 111) is used as a reference, the offset amounts of the first openings (slots) 106*a* to 106*c* are OFS2*a* to OFS2*c*. At this time, the offset amounts OFS1*a* to OFS1*c* are smaller than the offset amounts OFS2*a* to OFS2*c*. Accordingly, in the above-described third embodiment, as compared with the first conductor vias 104*a* to 104*c* of the first conductor vias 104 are not offset, the coupling amounts of the first openings (slots) 106*a* to 106*c* are reduced by the offset of the first conductor vias 104*a* to 104*c* of the first conductor vias 104. Since the lower limit of the clearance between the conductor vias and the slots is determined by the design rule, the realizable maximum coupling amount is reduced.

In the periodic leaky-wave antenna, however, the realizable maximum coupling amount is desirably large. The reasons are as follows. In the periodic leaky-wave antenna, a non-reflective termination is normally provided at a termination of the antenna in order to prevent occurrence of unnecessary beams caused by reflected waves. Occurrence of the unnecessary beams indicates that, in a case where the reflected waves are generated at the termination of the antenna, the reflected waves propagate in a direction opposite to the incident waves, and when the radiation direction of the leaky waves caused by the incident waves is "θ", unnecessary radiation occurs in a −θ direction. The residual power that passes through the antenna without being radiated from the slots (radiation elements) is absorbed at the non-reflective termination. Therefore, the absorbed power becomes loss. Further, the arrangement number of slots (radiation elements) is normally determined so as to obtain a necessary beam width in an application using the antenna. Accordingly, increasing the number of slots (number of radiation elements) to reduce the residual power in the case where the realizable maximum coupling amount becomes small influences the beam width and is not realistic. To reduce the residual power at the number of slots (number of radiation elements) determined from the desired beam width, namely, at the predetermined antenna length, it is necessary to increase the realizable coupling amounts of the slots (radiation elements).

In the fourth embodiment, the realizable coupling amounts of the slots is increased without increasing the number of slots. In a case where a center in the x-axis direction between the first conductor vias 104*a* to 104*c* of the first conductor vias 104 and the second conductor vias 105 that are located at the same positions in the y-axis direction as the first conductor vias 104*a* to 104*c* is used as a reference, the offset amounts of the first openings (slots) 106*a* to 106*c* are OFS3*a* to OFS3*c*. Further, in a case where a center of the longitudinal axis of the post-wall waveguide in a state before the first conductor vias 104*a* to 104*c* of the first conductor vias 104 are offset (in state where first conductor vias 104*a* to 104*c* of first conductor vias 104 are located on first straight line 111) is used as a reference, the offset amounts of the first openings (slots) 106*a* to 106*c* are OFS4*a* to OFS4*c*. At this time, the offset amounts OFS3*a* to OFS3*c* are larger than the offset amounts OFS4*a* to OFS4*c*. Accordingly, the coupling amounts of the first openings (slots) 106*a* to 106*c* are increased by the offset of the first conductor vias 104*a* to 104*c* of the first conductor vias 104. This makes it possible to reduce the residual power of the PLWA and to improve the antenna efficiency.

As described above, according to the fourth embodiment, the first conductor vias 104*a* to 104*c* of the first conductor vias 104 located on the side opposite to the offset side of the first openings (slots) 106*a* to 106*c* are offset to the outside of the post-wall waveguide. As a result, the realizable maximum coupling amount in each of the slots can be increased, which makes it possible to further improve the antenna efficiency of the PLWA.

Fifth Embodiment

An antenna apparatus according to the fifth embodiment is described below with reference to FIG. 7.

Figure 7:
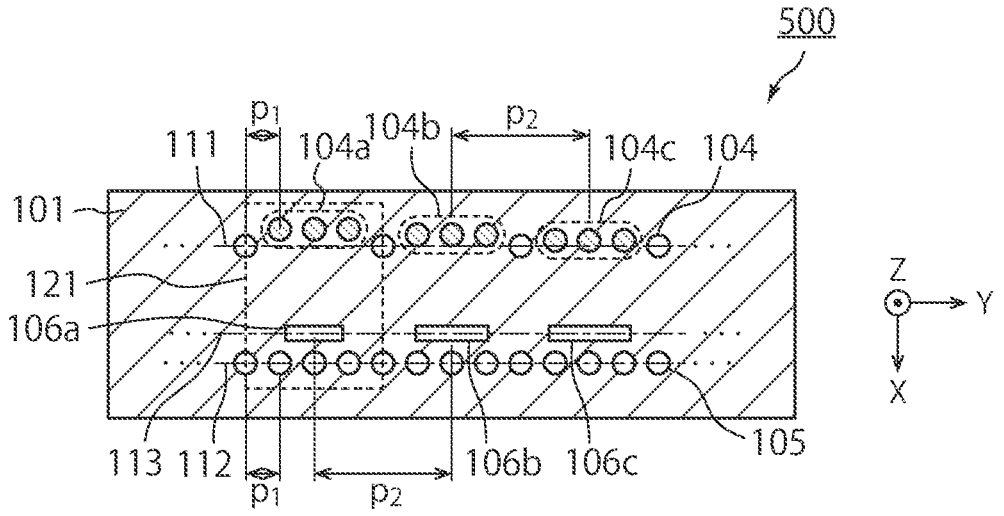
FIG. 7 is a top view of an antenna apparatus according to a fifth embodiment.

FIG. 7 is a top view of an antenna apparatus 500 according to the fifth embodiment. In the following description, components similar to the components in the fourth embodiment are denoted by the same reference numerals, and detailed description of the components is omitted.

The antenna apparatus 500 according to the fifth embodiment is different from the antenna apparatus according to the fourth embodiment in that the first openings 106*a* to 106*c* are arranged (arranged in straight line) on a third straight line 113 substantially parallel to the first straight line 111. As with the fourth embodiment, the first openings 106*a* to 106*c* are slots parallel to the longitudinal axis of the post-wall waveguide.

To reduce the residual power of the PLWA and to improve the antenna efficiency, the realizable maximum coupling amount of the slot is preferably large. The large coupling amount is realizable as the offset amounts of the first openings 106*a* to 106*c* from the longitudinal axis of the post-wall waveguide are large. Therefore, when the first openings 106*a* to 106*c* are offset as much as possible within a range following the design rule, the antenna efficiency can be improved.

Since the first openings 106*a* to 106*c* are arranged on the third straight line 113 substantially parallel to the first straight line 111, the offset amounts of the slots from the longitudinal axis of the post-wall waveguide are equal among all of the slots. The distance between the first openings 106*a* to 106*c* and the second conductor vias 105 is set to, for example, the lower limit of the clearance between the conductor vias and the slots determined by the design rule. In other words, the first openings 106*a* to 106*c* are offset as much as possible within the range following the design rule. In this configuration, the coupling amounts are controlled by the slot lengths. Further, the phase constants to the first openings 106*a* to 106*c* are adjusted by the offset amounts of the first conductor vias 104*a* to 104*c* of the first conductor vias 104 to the outside of the post-wall waveguide.

The arrangement of the first openings 106*a* to 106*c* on the third straight line 113 offers additional advantages. In the case where the first openings 106*a* to 106*c* are arranged in a straight line, cross-polarization components (components in x-axis direction) of the leaky waves radiated to the space outside the antenna are suppressed, and cross-polarization discrimination (XPD) of the antenna is improved, as compared with the case where the first openings 106 are not arranged in a straight line (see FIG. 6).

As described above, according to the fifth embodiment, the first openings 106*a* to 106*c* are offset so as to be arranged on the third straight line 113. This makes it possible to improve the antenna efficiency and the cross-polarization discrimination.

Sixth Embodiment

An antenna apparatus according to the sixth embodiment is described below with reference to FIG. 8.

Figure 8:
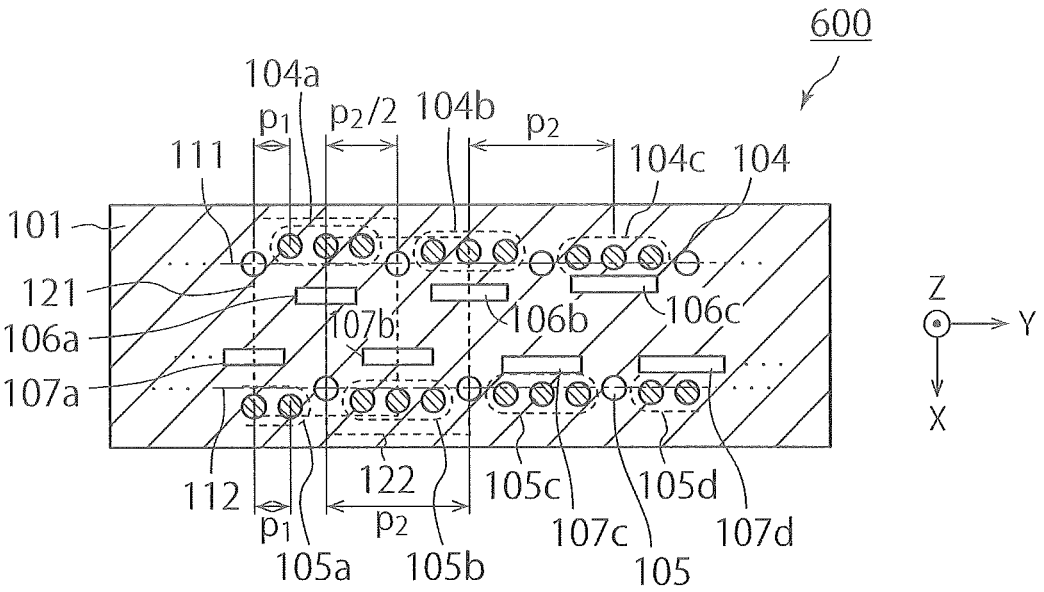
FIG. 8 is a top view of an antenna apparatus according to a sixth embodiment.

FIG. 8 is a top view of an antenna apparatus 600 according to the sixth embodiment. In the following description, components similar to the components in the third embodiment are denoted by the same reference numerals, and detailed description of the components is omitted.

The antenna apparatus 600 according to the sixth embodiment is different from the antenna apparatus according to the third embodiment (see FIG. 5) in that second openings 107 (107*a*, 107*b*, 107*c*, and 107*d*) operating as radiation elements are provided in addition to the first openings 106 in the region of the first conductor layer 101 sandwiched between the first straight line 111 and the second straight line 112.

Further, in the sixth embodiment, among the second conductor vias 105, the second conductor vias 105*a* to 105*d* that are located at positions corresponding to the second openings 107 are also offset to the outside from the longitudinal axis of the post-wall waveguide. Among the plurality of second conductor vias 105, the second conductor vias 105*a* to 105*d* arranged at the positions corresponding to the second openings 107*a* to 107*d* are located at different positions in the x-axis direction, dependently on the coupling amounts of the second openings 107*a* to 107*d*. In the x-axis direction, the second conductor vias 105*a* to 105*d* are located on a side opposite to the plurality of first conductor vias 104 with respect to the positions of the second conductor vias 105 other than the second conductor vias 105*a* to 105*d*. The second openings 107*a* to 107*d* are reduced in distance from the respective second conductor vias 105*a* to 105*d* at the positions corresponding to the second openings 107*a* to 107*d* as it goes in the waveguide direction. Among the second conductor vias, the offset conductor vias 105*a* to 105*d* correspond to fifth conductor vias.

The plurality of second openings 107 are arranged in a direction (in fifth direction or y-axis direction) substantially parallel to the second straight line 112 or the longitudinal axis such that the interval in the y-axis direction becomes the second period "$p_2$". The first openings 106 (106*a*, 106*b*, and 106*c*) and the second openings 107 are slots, the longitudinal direction of each of which is parallel to the longitudinal axis of the post-wall waveguide (i.e., y-axis direction). The second period "$p_2$" is four times the first period "$p_1$". However, the second period "$p_2$" is not limited to four times as long as the second period "$p_2$" is an even multiple of the first period "$p_1$".

The first openings 106 are offset toward the first conductor vias 104 from the longitudinal axis of the post-wall waveguide (center line between first straight line 111 and second straight line 112). The second openings 107 are offset toward the second conductor vias 105 from the longitudinal axis of the post-wall waveguide. In other words, the first openings 106 and the second openings 107 are offset to the sides opposite to each other with respect to the longitudinal axis of the post-wall waveguide.

Further, the first openings 106 and the second openings 107 are arranged so as to be shifted by substantially half of the second period "$p_2$" in the y-axis direction. In other words, the slots arranged as the radiation elements are arranged at a period substantially half of the second period "$p_2$" in the y-axis direction, and are alternately offset to the opposite sides with respect to the longitudinal axis of the post-wall waveguide.

The antenna apparatus 600 according to the sixth embodiment operates as the periodic leaky-wave antenna (PLWA) as with the above-described first to fifth embodiments. However, since the arrangement period of the leaking structure (radiation elements) is substantially half of the second period "$p_2$", the phase constant of the Floquet mode is different from the phase constant represented by the expression (5). Offset of the slots to the opposite side with respect to the longitudinal axis of the post-wall waveguide corresponds to inversion of the phase. Therefore, when the half of the second period "$p_2$" is a third period "$p_3$" ($p_3=p_2/2$), the phase constant of the Floquet mode in the periodic structure having such a phase inverted structure is represented by an expression (7).

$$\beta_{yn} = \beta_0 + \frac{(2n+1)\pi}{p_3} \tag{7}$$

Accordingly, the phase constants are not basically coincident between the case without phase inversion as with the above-described first to fifth embodiments and the case with phase inversion as with the sixth embodiment even though the order of the Floquet mode is the same. Thus, the radiation directions of the leaky waves corresponding to the order are different between the cases; however, the phase constants for the −1th-order mode are coincident between the cases. More specifically, the phase constant of −1th-order Floquet mode in a case where the order "n" is set to −1 in the expression (5) and the phase constant of −1th-order Floquet mode in a case where the order "n" is set to −1 and the third period "$p_3$" is set to the half of the second period "$p_2$" ($p_3=p_{2/2}$) in the expression (7) are both represented by an expression (8).

$$\beta_{y-1} = \beta_0 - \frac{2\pi}{p_2} \tag{8}$$

Since the phase constants are equal to each other, the radiation direction of the leaky waves caused by the −1th-order Floquet mode is the same between the sixth embodiment and the first to fifth embodiments, irrespective of presence/absence of the phase inversion.

The beam width of the antenna is determined by the antenna length. Therefore, the antenna length is determined by the beam width desired by the application using the antenna. In the antenna apparatus 600 according to the sixth embodiment, the number of slots to be able to arranged per the antenna length is doubled as compared with the antenna apparatus 400 (see FIG. 5) according to the third embodiment. Therefore, the power radiated from the predetermined antenna length is also increased. As a result, the residual power that passes through the antenna without being radiated from the slots can be reduced, which makes it possible to improve the antenna efficiency. In particular, in a case where the antenna length is short, the residual power is easily increased. Therefore, an improvement degree of the antenna efficiency is large.

In contrast, in a case of an antenna that has a long antenna length and is less deteriorated in antenna efficiency by the residual power, the slots each having a smaller coupling amount can be used. In this case, advantageously, the adjustment amounts of the phase constants are reduced, and the reflection amounts caused by the slots are reduced.

The antenna apparatus 600 according to the sixth embodiment has the structure in which the first unit cells 121 and the second unit cells 122 are arranged in the y-axis direction so as to be shifted by substantially half of the second period "$p_2$", and the first unit cells 121 and the second unit cells 122 are each arrayed at the second period "$p_2$" in the y-axis direction. The first unit cells 121 each include four first conductor vias 104, four second conductor vias 105, one first opening 106, and a half portion of each of two second openings 107. The second unit cells 122 each include four first conductor vias 104, four second conductor vias 105, one second opening 107, and a half portion of each of two first openings 106. The first unit cell 121 and the second unit cell 122 adjacent to each other in the y-axis direction have structures substantially inverted from each other in the x-axis direction. For example, the first unit cell 121 including the first opening 106*b* and the second unit cell 122 including the second opening 107*b* have structures substantially inverted from each other in the x-axis direction. The first unit cell 121 including the first opening 106*b* and the second unit cell 122 including the second opening 107*c* have structures substantially inverted from each other in the x-axis direction.

As described above, in the case where the second period "$p_2$" is set to an integer multiple of the first period "$p_1$", the relative positional relationship in the y-axis direction between the first conductor vias 104 and the second conductor vias 105 with respect to the first openings 106 is substantially equivalent for all of the slots (first openings 106). The relative positional relationship in the y-axis direction between the first conductor vias 104 and the second conductor vias 105 with respect to the second openings 107 are substantially equivalent for all of the slots (second openings 107).

Moreover, since the first unit cells 121 and the second unit cells 122 have the structures substantially inverted from each other in the x-axis direction in the figure, the relative positional relationship in the y-axis direction between the slots and the conductor vias is substantially equivalent for all of the slots (first openings and second openings). For example, the offset amount of the second conductor via 105*b* is substantially the same as the offset amount of the first conductor via 104*b*, and the offset amount of the second conductor via 105*c* is substantially the same as the offset amount of the first conductor via 104*c*. The offset amount of the second conductor via 105*a* is substantially the same as the offset amount of the first conductor via 104*a*. The offset amount of the second conductor via 105*d* is substantially the same as the offset amount of some (not illustrated) of the unillustrated first conductor vias on the right side of the first conductor via 104*c*. Accordingly, adjusting the slot lengths of the slots, the offset amounts of the slots from the longitudinal axis of the post-wall waveguide, and the offset amounts of the first conductor vias 104*a* to 104*c* of the first conductor vias 104 or the offset amounts of the second conductor vias 105*a* to 105*d* of the second conductor vias 105 makes it possible to continuously or stepwisely control the coupling amounts of the slots under the condition obtaining the same phase constants among the slots. The offset amounts of the first conductor vias 104*a* to 104*c* of the first conductor vias 104 or the offset amounts of the second conductor vias 105*a* to 105*d* of the second conductor vias 105 are adjusted dependently on, for example, the coupling amount of the slot (first opening or second opening) included in the corresponding unit cell.

In FIG. 8, a distance (second distance) in the x-axis direction from one of the fifth conductor vias to the second conductor via other than the plurality of fifth conductor vias is larger than a distance (third distance) in the x-axis direction from the other on a propagation side of electromagnetic wave in the y-axis direction of the fifth conductor vias to the second conductor via other than the plurality of fifth conductor vias. Further, a distance (fourth distance) in the x-axis direction from one of the second openings to the second conductor via other than the plurality of fifth conductor vias is larger than a distance (fifth distance) in the x-axis direction from the other on the propagation side in the y-axis direction of the second openings to the second conductor via other than the plurality of fifth conductor vias.

As described above, according to the sixth embodiment, the first openings 106 and the second openings 107 are arranged as the radiation elements. As a result, the double number of slots can be arranged in the predetermined antenna length providing the desired beam width, and radiable power from the predetermined antenna length is increased.

Further, since the arrangement period of the first openings 106 and the arrangement period of the second openings 107 are made equal to each other, the radiation direction of the −1th-order Floquet mode is coincident with the radiation direction in each of the above-described first to fifth embodiments. Accordingly, in the antenna with the same desired radiation direction and the same desired beam width, the antenna efficiency and the reflection characteristics are improved.

Seventh Embodiment

An antenna apparatus according to the seventh embodiment is described below with reference to FIG. 9.

Figure 9:
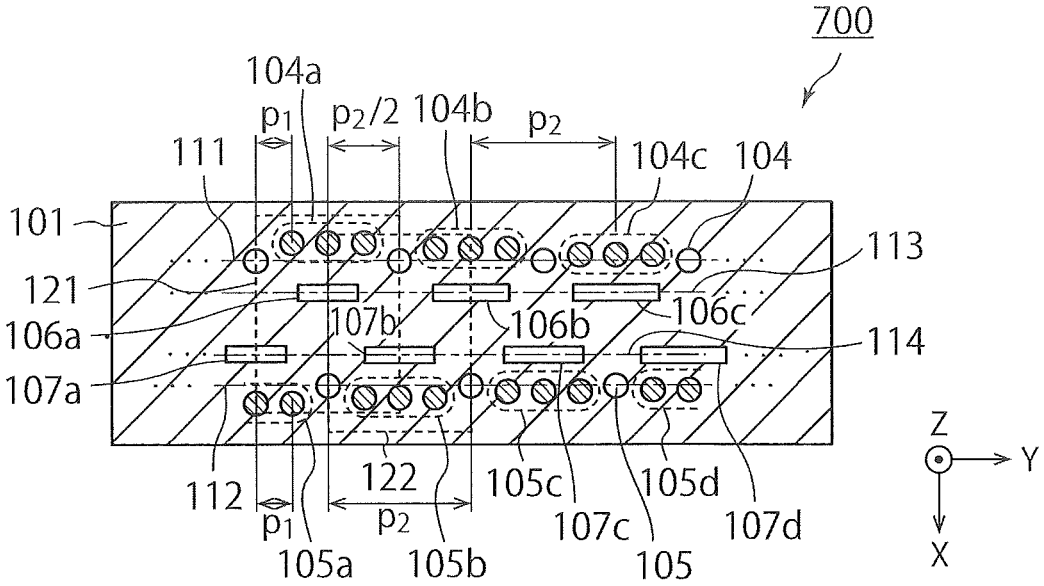
FIG. 9 is a top view of an antenna apparatus according to a seventh embodiment.

FIG. 9 is a top view of an antenna apparatus 700 according to the seventh embodiment. In the following description, components similar to the components in the sixth embodiment are denoted by the same reference numerals, and detailed description of the components is omitted.

The antenna apparatus 700 according to the seventh embodiment is different from the antenna apparatus according to the sixth embodiment in that the first openings 106*a* to 106*c* are arranged (arranged in straight line) on the third straight line 113 substantially parallel to the first straight line 111, and the second openings 107*a* to 107*d* are arranged (arranged in straight line) on a fourth straight line 114 substantially parallel to the second straight line 112.

To reduce the residual power of the PLWA and to improve the antenna efficiency, the realizable maximum coupling amount of the slot is preferably large. The large coupling amount is realizable as the offset amounts of the slots (first openings 106*a* to 106*c* and second openings 107*a* to 107*d*) from the post-wall waveguide are large. The phase delay occurred in the slots are also increased as the coupling amounts of the slots are large. Therefore, the offset amounts of the conductor vias in the unit cell including the slot having the maximum coupling amount are made minimum.

For example, in a case where the slot having the maximum coupling amount is included in a certain first unit cell 121, the offset amount of the first conductor via 104*a* of the first conductor vias 104 in that cell becomes the minimum among all of the unit cells (first unit cells 121 and second unit cells 122). In contrast, in a case where the slot having the maximum coupling amount is included in a certain second unit cell 122, the offset amount of the second conductor via 105*a* of the second conductor vias 105 in that cell becomes the minimum among all of the unit cells (second unit cells 122 and first unit cells 121).

To optimize the antenna efficiency according to the design rule, the conductor vias are not offset to the outside of the post-wall waveguide in the unit cell including the slot (106 or 107) having the maximum coupling amount. Further, in that unit cell, the slots are offset such that the clearance between the slots and the conductor vias becomes the lower limit in the design rule. The offset amounts of the other slots from the longitudinal axis of the post-wall waveguide are made equal to the offset amount of the slot having the maximum coupling amount (however, offset directions of first openings 106 and second openings 107 are opposite to each other). As a result, the coupling amounts of the slots can be continuously or stepwisely controlled with use of only the slot lengths and the offset amounts of the conductor vias as the parameters, under the condition to obtain the same phase constant in each of the slots.

Further, since the first openings 106 and the second openings 107 are respectively arranged on the third straight line 113 and the fourth straight line 114 that are parallel to each other, the cross-polarization components (components in x-axis direction) of the leaky waves radiated to the space outside the antenna are suppressed, and the cross-polarization discrimination (XPD) of the antenna is improved.

As described above, according to the seventh embodiment, the first openings (slots) 106 are arranged on the third straight line 113 substantially parallel to the longitudinal axis of the post-wall waveguide, and the second openings (slots) 107 are arranged on the third straight line 113 substantially parallel to the longitudinal axis of the post-wall waveguide. As a result, the coupling amounts of the slots can be continuously or stepwisely controlled with use of only the slot lengths and the offset amounts of the conductor vias as the parameters, under the condition to obtain the same phase constant in each of the slots. Further, the antenna efficiency can be optimized within a range following the design rule, and the cross-polarization discrimination can be also improved.

Eighth Embodiment

An antenna apparatus according to the eighth embodiment is described below with reference to FIG. 10.

Figure 10:
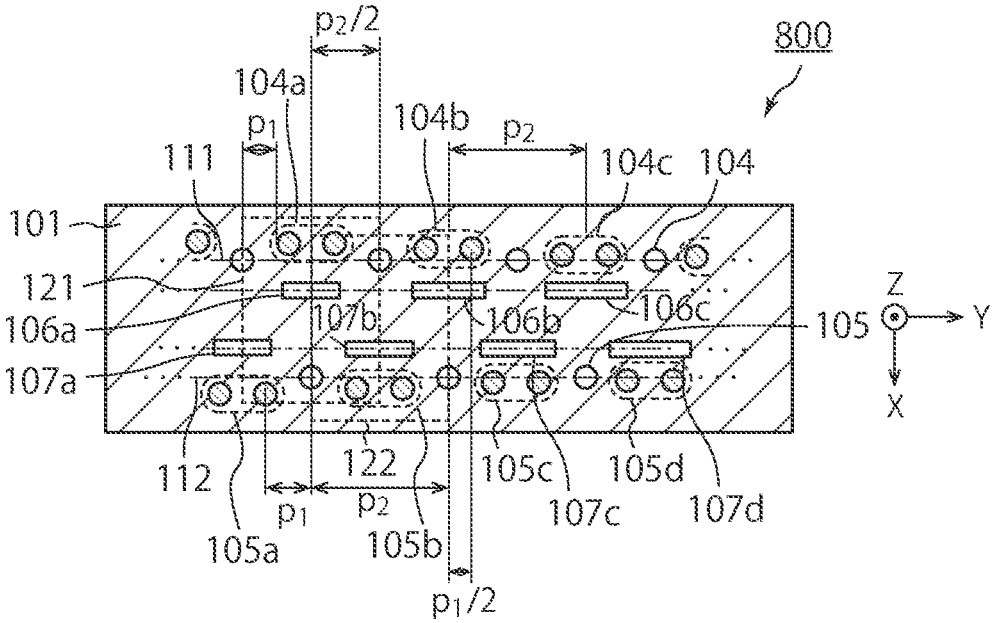
FIG. 10 is a top view of an antenna apparatus according to an eighth embodiment.

FIG. 10 is a top view of an antenna apparatus 800 according to the eighth embodiment. In the following description, components similar to the components in the seventh embodiment are denoted by the same reference numerals, and detailed description of the components is omitted.

The antenna apparatus 800 according to the eighth embodiment is different from the antenna apparatus according to the seventh embodiment in that the first conductor vias 104 and the second conductor vias 105 are arranged so as to be shifted by substantially half of the first period "$p_1$" in the longitudinal axis direction of the post-wall waveguide (i.e., in y-axis direction). The first period "$p_1$" is the arrangement period of the first conductor vias 104 and the second conductor vias 105.

In the first to seventh embodiments, the first conductor vias 104 and the second conductor vias 105 configuring the narrow walls of the post-wall waveguide are arranged at the same coordinates (i.e., y-coordinates in figure) in the longitudinal axis direction of the post-wall waveguide. For example, in the antenna apparatus 700 according to the seventh embodiment illustrated in FIG. 9, the y-coordinates of the first conductor vias 104 and the y-coordinates of the second conductor vias 105 are equal to each other.

In the above-described seventh embodiment (see FIG. 9), $p_2=4p_1$ is established, namely, the second period "$p_2$" is an even multiple of the first period "$p_1$", and the first unit cells 121 and the second unit cells 122 that have the structures substantially inverted from each other in the x-axis direction (except for the slots each included by half) are arrayed. However, if the second period "$p_2$" is an odd multiple of the first period "$p_1$" in the seventh embodiment, the first unit cell 121 and the second unit cell 122 do not have the structures substantially inverted from each other in the x-axis direction. In other words, the relative positional relationship in the y-axis direction between the first openings 106 and the first conductor vias 104 in each of the first unit cells 121 is not equivalent to the relative positional relationship in the y-axis direction between the second openings 107 and the second conductor vias 105 in each of the second unit cells 122. Accordingly, it is necessary to determine the parameters different between the first openings and the second openings, and to adjust the phase constants to the respective unit cells. This deteriorates designability of the antenna.

In the antenna apparatus 800 according to the eighth embodiment, the second period "$p_2$" is an odd multiple of the first period "$p_1$", and the first unit cells 121 and the second unit cells 122 have structures substantially inverted from each other in the x-axis direction. More specifically, in the eighth embodiment, $p_2=3p_1$ is established. Further, the first conductor vias 104 and the second conductor vias 105 are arranged so as to be shifted by substantially half of the first period "$p_1$" in the y-axis direction in the figure. As a result, the first unit cells 121 and the second unit cells 122 have the structures substantially inverted from each other in the x-axis direction. Accordingly, even in the case where the second period "$p_2$" is an odd multiple of the first period "$p_1$", the coupling amounts of the slots can be continuously or stepwisely controlled with use of only the slot lengths and the offset amounts of the conductor vias, under the condition to obtain the same phase constant in each of the slots.

As described above, according to the eighth embodiment, the second period "$p_2$" is an odd multiple of the first period "$p_1$", and the first conductor vias 104 and the second conductor vias 105 are arranged so as to be shifted by substantially half of the first period "$p_1$" in the longitudinal axis direction of the post-wall waveguide. As a result, the first unit cells 121 each including the first opening 106 and the second unit cells 122 each including the second opening 107 have the structures substantially inverted from each other in a direction perpendicular to the longitudinal axis of the post-wall waveguide. Accordingly, the coupling amounts of the slots can be continuously or stepwisely controlled with use of only the slot lengths and the offset amounts of the conductor vias as the parameters, under the condition to obtain the same phase constant in each of the slots.

In the description of the above-described first to eighth embodiments, the antenna is a one-dimensional array antenna including an array of post-wall waveguides. As another embodiment, the one-dimensional array antenna may be used as a sub-array, the sub-arrays may be arrayed in the direction perpendicular to the longitudinal axis of the post-wall waveguide to configure a two-dimensional array antenna.

Ninth Embodiment

Figure 11:
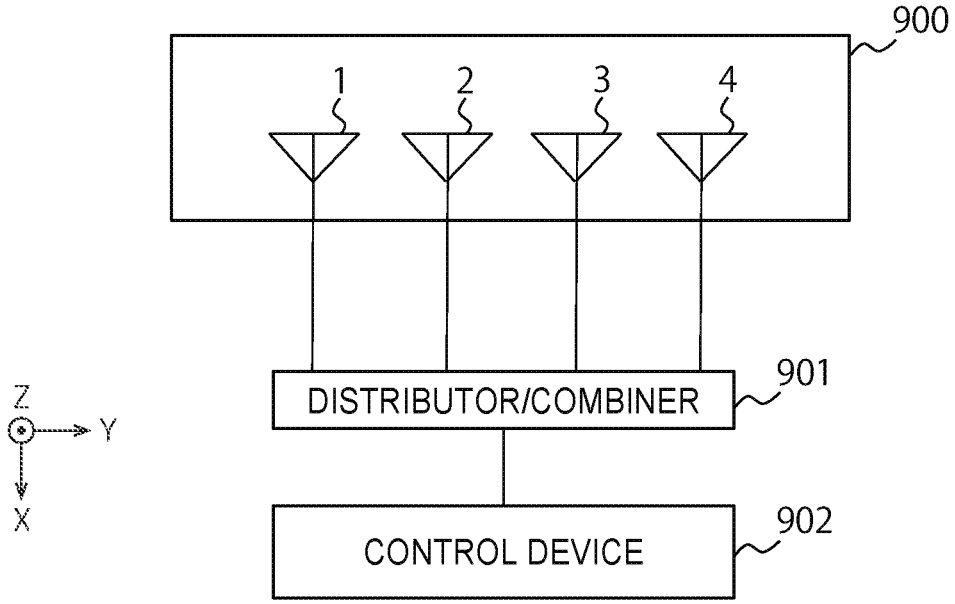
FIG. 11 is a block diagram of a search apparatus according to a ninth embodiment.

FIG. 11 is a schematic block diagram of a search apparatus according to the ninth embodiment. The search apparatus illustrated in FIG. 11 includes an array antenna apparatus 900, a distributor/combiner 901, and a control device 902. The control device 902 includes an optional circuit such as a dedicated circuit, a microprocessor and a central processing unit (CPU), software such as programs, or a combination thereof.

The array antenna apparatus 900 includes a plurality of antenna apparatuses 1 to 4 each corresponding to the antenna apparatus according to any of the first to eighth embodiments. The distributor/combiner 901 includes a distributor that divides a signal supplied from the control device 902 into four signals and supplies the divided signals to the antenna apparatuses 1 to 4, and a combiner that combines signals output from the antenna apparatuses 1 to 4 and outputs a combined signal to the control device 902.

The control device 902 can rotate directions of radio waves (beams) radiated from the antenna apparatuses 1 to 4 by changing frequencies of the signals supplied to the antenna apparatuses 1 to 4. As an example, the antenna apparatuses 1 to 4 are arranged such that respective antenna opening surfaces are directed in directions parallel to one another (e.g., directions parallel to Z-axis). The radiation directions of the radio waves radiated from the antenna apparatuses 1 to 4 can be changed within a prescribed range with the Y-axis as a reference axis in directions parallel to surfaces of the X-axis and the Z-axis.

As an example, the control device 902 receives reflected waves of radio signals transmitted from the antenna apparatuses 1 to 4, and performs threshold determination on power of the radio signals of the received reflected waves to detect a search object. As an example, when the power is greater than or equal to a threshold, it is determined that the search object is present in the radiation direction of the radio waves of the antenna apparatus in which the power greater than or equal to the threshold has been detected. The arrangement positions and the arrangement number of antenna apparatuses may be determined based on a radiable range of each of the antenna apparatuses and a search area where the search object is searched. The antenna apparatuses may be operated simultaneously or sequentially.

The configuration in which the search object is detected through the threshold determination of the power of the reflected waves is illustrative, and the search object may be detected by the other method. For example, it is assumed that the control device 900 has a function to read out a radio frequency identification (RFID) tag, and the search object has an RFID tag. In this case, the control device 900 changes the frequencies of the signals supplied to the antenna apparatuses 1 to 4, and performs scanning with beams including radio signals (read signals) by the antenna apparatuses. When the control device 900 reads out a tag ID from the RFID tag, the control device 900 may specify the antenna apparatus that has received the signal of the tag ID and the radiation direction of the beams from the antenna apparatus at that time, thereby detecting the search object. Further, the control device 900 may detect a distance from each of the antenna apparatuses to the search object based on difference between the frequency of the radio waves radiated from each of the antenna apparatuses and the frequency of the reflected radio waves. The control device 900 may specify the position of the search object based on a distance from each of the antenna apparatuses and the search object.

As described above, according to the ninth embodiment, the array antenna apparatus 900 is configured by using the antenna apparatuses according to any of the first to eighth embodiments. In the antenna apparatuses according to any of the first to eighth embodiments, the radiation angles from the slots are aligned with high accuracy. Therefore, an antenna gain obtained from directivity synthesis of the slots is high. This makes it possible to perform searching with high efficiency and high accuracy.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An antenna apparatus, comprising:

a first conductor layer;

a second conductor layer;

a dielectric layer between the first conductor layer and the second conductor layer;

a plurality of first conductor vias arranged at a first interval in a first direction to penetrate through the dielectric layer and to electrically connect the first conductor layer and the second conductor layer;

a plurality of second conductor vias arranged opposite to the first conductor vias at the first interval in the first direction to penetrate through the dielectric layer, and to electrically connect the first conductor layer and the second conductor layer; and a plurality of first openings in a region of the first conductor layer between the plurality of first conductor vias and the plurality of second conductor vias, the plurality of first openings being arranged, in the first direction, at a second interval that is an integer multiple of the first interval, wherein a plurality of third conductor vias are part of the plurality of first conductor vias that are separated by a first distance or less from a corresponding one of the plurality of first openings in the first direction, the plurality of third conductor vias being arranged at positions that are offset, in a second direction, from positions of intervening other ones of the plurality of first conductor vias, the plurality of third conductor vias being interspersed among the intervening other ones of the plurality of first conductor vias and the second direction being substantially orthogonal to the first direction and substantially parallel to the first conductor layer.

2. The antenna apparatus according to claim 1, wherein the positions of the plurality of third conductor vias in the second direction are different dependently on areas of the plurality of first openings or positions of the plurality of first openings in the second direction.

3. The antenna apparatus according to claim 1, wherein the positions of the plurality of third conductor vias in the second direction are opposite to the plurality of second conductor vias with respect to the intervening other ones of the plurality of first conductor vias.

4. The antenna apparatus according to claim 1, wherein the first distance is dependent on a difference between a maximum coupling amount and a minimum coupling amount among a plurality of coupling amounts held by the plurality of first openings.

5. The antenna apparatus according to claim 1, wherein, a plurality of fourth conductor vias are part of the plurality of second conductor vias and are arranged corresponding to the plurality of first openings, positions of the plurality of fourth conductor vias in the second direction are different dependently on areas of the plurality of first openings or the positions of the plurality of first openings in the second direction.

6. The antenna apparatus according to claim 5, wherein, the positions of the plurality of fourth conductor vias in the second direction are opposite to the plurality of first conductor vias with respect to others of the second conductor vias.

7. The antenna apparatus according to claim 5, wherein the plurality of fourth conductor vias are conductor vias that are separated by the first distance or less from the plurality of first openings in the first direction, and the first distance is dependent on a difference between a maximum coupling amount and a minimum coupling amount of a plurality of coupling amounts held by the plurality of first openings.

8. The antenna apparatus according to claim 1, wherein a second distance in the second direction from one of the plurality of third conductor vias to the intervening other ones of the plurality of first conductor vias is larger than a third distance in the second direction from another one of the plurality of third conductor vias to the intervening other ones of the plurality of first conductor vias, the another one of the plurality of third conductor vias being located on a propagating side of electromagnetic wave in the first direction with respect to the one of the plurality of third conductor vias.

9. The antenna apparatus according to claim 1, wherein a fourth distance in the second direction from one of the plurality of first openings to the intervening other ones of the plurality of first conductor vias is larger than a fifth distance in the second direction from another one of the plurality of first openings to the intervening other ones of the plurality of first conductor vias, the another one of the plurality of first openings being located on a propagating side of electromagnetic wave in the first direction.

10. The antenna apparatus according to claim 1, comprising a plurality of second openings in the first direction in the region of the first conductor layer, wherein a plurality of fifth conductor vias are part of the plurality of second conductor vias and are arranged corresponding to the plurality of second openings, positions of the plurality of fifth conductor vias in the second direction are different dependently on areas of the plurality of second openings or positions of the plurality of second openings in the second direction.

11. The antenna apparatus according to claim 10, wherein, the positions of the plurality of fifth conductor vias in the second direction are opposite to the plurality of first conductor vias with respect to others of the second conductor vias.

12. The antenna apparatus according to claim 10, wherein a second distance in the second direction from one of the plurality of fifth conductor vias to others of the plurality of second conductor vias is larger than a third distance in the second direction from another one of the plurality of fifth conductor vias to the others of the plurality of second conductor vias, the another one of the plurality of fifth conductor vias being located on a propagating side of electromagnetic wave in the first direction with respect to the one of the plurality of fifth conductor vias.

13. The antenna apparatus according to claim 10, wherein a fourth distance in the second direction from one of the plurality of second openings to others of the plurality of second conductor vias is larger than a fifth distance in the second direction from another one of the plurality of second openings to the others of the plurality of second conductor vias, the another one of the plurality of second openings being located on a propagating side of electromagnetic wave in the first direction with respect to the one of the plurality of second openings.

14. The antenna apparatus according to claim 10, wherein the plurality of second openings are arranged at the second interval in the first direction, intervals between the plurality of first openings and the plurality of second openings is half of the second interval, and the plurality of fifth conductor vias are conductor vias that are separated by the first distance or less from the plurality of second openings in the first direction, and the first distance is dependent on a difference between a maximum coupling amount and a minimum coupling amount among a plurality of coupling amounts held by the plurality of second openings.

15. The antenna apparatus according to claim 14, wherein intervals between the plurality of first conductor vias and the plurality of second conductor vias in the first direction is half of the first interval.

16. The antenna apparatus according to claim 1, wherein the plurality of first conductor vias are provided at same positions as the plurality of second conductor vias in the first direction.

17. The antenna apparatus according to claim 10, wherein a longitudinal length or an area of one of the plurality of second openings is smaller than a longitudinal length or an area of another one of the plurality of second openings, the another one of the plurality of second openings being located on a propagating side of electromagnetic wave in the first direction with respect to the one of the plurality of second openings.

18. The antenna apparatus according to claim 10, wherein a longitudinal length or an area of one of the plurality of second openings is smaller than a longitudinal length or an area of another one of the plurality of second openings, the another one of the plurality of second openings being located on a propagating side of electromagnetic wave in the first direction with respect to the one of the plurality of second openings.

19. A search apparatus, comprising:

the antenna apparatus according to claim 1; and a control device configured to transmit a first radio signal through the antenna apparatus, and to estimate, based on a second radio signal received through the antenna apparatus in response to the first radio signal, at least one of a direction of a transmission source of the second radio signal, a position of the transmission source, and a distance to the transmission source.

20. The antenna apparatus according to claim 1, wherein the plurality of second conductor vias are aligned in the first direction.

* * * * *